US005915906A

United States Patent [19]

Lücking et al.

[11] Patent Number: 5,915,906

[45] Date of Patent: Jun. 29, 1999

[54] APPARATUS FOR LOADING AND UNLOADING A SHIP

[75] Inventors: Manfred Lücking; Dieter Zimek, both of Essen, Germany

[73] Assignee: Krupp Fordertechnik GmbH, Essen, Germany

[21] Appl. No.: 08/994,298

[22] Filed: Dec. 19, 1997

[30] Foreign Application Priority Data

Jan. 9, 1997 [DE] Germany ..... 197 00 469

[51] Int. Cl.[6] ..... B63B 27/16

[52] U.S. Cl. ..... 414/142.8; 212/273; 294/81.41

[58] Field of Search ..... 212/272, 273; 294/67.5, 81.53, 81.41; 414/141.7, 142.8

[56] References Cited

U.S. PATENT DOCUMENTS

| | | | |
|---|---|---|---|
| 1,900,867 | 3/1933 | Olds . | |
| 3,247,974 | 4/1966 | Dechantsreiter . | |
| 3,515,086 | 6/1970 | Auzins et al. | 414/142.8 X |
| 3,722,705 | 3/1973 | Gould | 414/141.7 X |
| 4,431,359 | 2/1984 | Toniolo | 414/459 X |
| 4,662,300 | 5/1987 | McCallum et al. | 212/273 X |
| 5,478,181 | 12/1995 | Rudolf, III et al. | 212/273 X |
| 5,538,382 | 7/1996 | Hasegawa | 414/141.7 |

FOREIGN PATENT DOCUMENTS

| | | | |
|---|---|---|---|
| 0347784 | 12/1989 | European Pat. Off. . | |
| 458107 | 10/1913 | France . | |
| 2067371 | 8/1971 | France . | |
| 2253699 | 7/1975 | France . | |
| 359528 | 9/1922 | Germany . | |
| 1556636 | 10/1970 | Germany . | |
| 41 02 795 | 8/1992 | Germany | 212/273 |
| 4329470 | 3/1995 | Germany . | |
| 4342522 | 6/1995 | Germany . | |
| 5-85694 | 4/1993 | Japan | 212/273 |
| 08104491 | 4/1996 | Japan . | |
| 900293 | 7/1962 | United Kingdom . | |
| 1045052 | 10/1966 | United Kingdom . | |
| WO 95/06613 | 3/1995 | WIPO . | |

OTHER PUBLICATIONS

"Schiff und Hafen", H. 11, 1972, 24 yr, pp. 858, 859.

*Primary Examiner*—Janice L. Krizek
*Attorney, Agent, or Firm*—Herbert Dubno; Andrew Wilford

[57] ABSTRACT

An apparatus for loading into and unloading objects from a ship has a horizontally displaceable support, a frame having a lower end, guides supporting the frame on the support only for vertical movement relative thereto, and a grab below the frame engageable with the objects. A mainly vertically extending cable is connected to the grab and vertically interengageable formations on the grab and frame lower end, when engaged together, arrest the grab horizontally relative to the frame. A winch or other drive is connected to the cable for reeling in and paying out the cable and thereby raising and lowering the grab relative to the frame lower end and bringing the formations into and out of engagement with each other.

12 Claims, 3 Drawing Sheets

APPARATUS FOR LOADING AND UNLOADING A SHIP

FIELD OF THE INVENTION

The present invention relates to an apparatus for loading and unloading a ship. More particularly this invention concerns a crane-mounted device for taking transcontainers out of and loading them into a ship.

BACKGROUND OF THE INVENTION

Transcontainers and other large bulky freight are typically loaded into and unloaded from a ship by means of an apparatus having a horizontally displaceable support, a frame having a lower end and supported for vertical movement on the support, and a grab carried on the lower end of the support. Alternately the grab can be suspended from the support by cables.

With each system the grab is dropped down onto the object being picked up, clamps or the like are engaged to lock the grab to the object, and then the grab is pulled back up. The freight is then displaced horizontally by movement of the support, which can either ride on a portal or be mounted on an arm of a crane, to a location above the drop-off location where the grab is lowered and the clamps are released.

As described in U.S. Pat. No. 1,900,867 and German 1,556,636, hooks or spreaders are used to pick up the objects being moved. Such arrangements are particularly difficult to use in that they must be positioned perfectly above the object being picked up in order to engage the grab with the object, normally fitting it to standardized fittings on the transcontainer. In addition once the object is lifted clear and it is to be moved horizontally, the object is likely to swing or sway, making it difficult to handle and normally requiring that it be moved quite slowly to minimize this problem. While it has been suggested in German 4,342,522 to provide actuators to align the grab with the object, this solution is imperfect and does nothing to prevent the load from swaying when transported horizontally.

SUMMARY OF THE INVENTION

An apparatus for loading into and unloading objects from a ship has according to the invention a horizontally displaceable support, a frame having a lower end, guides supporting the frame on the support only for vertical movement relative thereto, and a grab below the frame engageable with the objects. A mainly vertically extending cable is connected to the grab and vertically interengageable formations on the grab and frame lower end, when engaged together, arrest the grab horizontally relative to the frame. A winch or other drive is connected to the cable for reeling in and paying out the cable and thereby raising and lowering the grab relative to the frame lower end and bringing the formations into and out of engagement with each other.

Thus with this system the grab can be dropped a substantial distance, hanging from the cable, into the hold or a ship or another deep place to pick up or drop off an object, normally a transcontainer. During horizontal transport of the object being picked up or dropped off, it is held against the lower end of the frame so that it will not rock or swing. Only when the apparatus is directly above the pick-up or drop-off location is the object not securely held against the solid structure of the frame.

The drive that pulls in and pays out the cable can be mounted on the support or on the frame. The cable's outer end can be fixed to the grab, or the cable can be spanned over idler rollers on the on the support and on the grab and connected to the frame.

In accordance with the invention horizontally effective actuators are engaged between the grab or the frame and the respective formations. This makes it possible to perfectly center the grab on the object being picked up once it is lowered into place, or to perfectly position the object over a drop-off location before setting it down.

The formations according to the invention can include at least one horizontally extending bolt and at least one socket having a horizontally extending recess complementary to the bolt. This bolt and socket can both be complementarily X-shaped.

Guides in accordance with the invention are provided in the frame horizontally engageable with the cable. In addition the grab is provided with rollers engageable with the object. A vertically extensible actuator can be engaged between the frame and the support.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
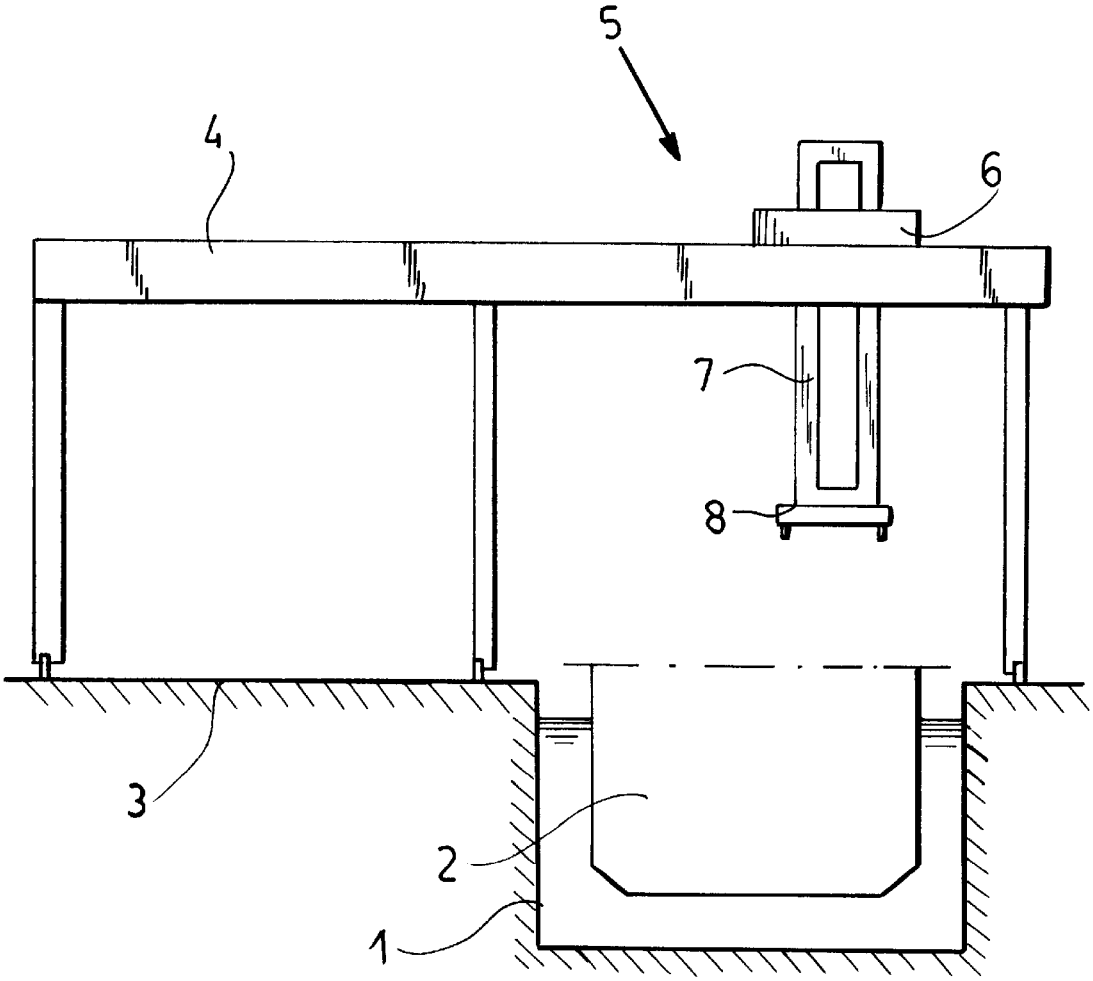
FIG. 1 is a small scale and partly diagrammatic view illustrating the apparatus of this invention.

As seen in FIG. 1 a ship 2 sits in a harbor or body of water 1 adjacent land or a dock 3 provided here with a large portal frame 4 for a loading and unloading apparatus 5. The apparatus 5 comprises at its most basic a support formed by a truck or carriage 6 that is horizontally movable on the portal frame 4, which itself is movable in a direction perpendicular to the view plane of FIG. 1, and carries a vertically displaceable frame 7 and, at a lower end of this frame 7, a grab 8 here constituted as a spreader adapted to fit with standard transcontainers.

Figure 2:
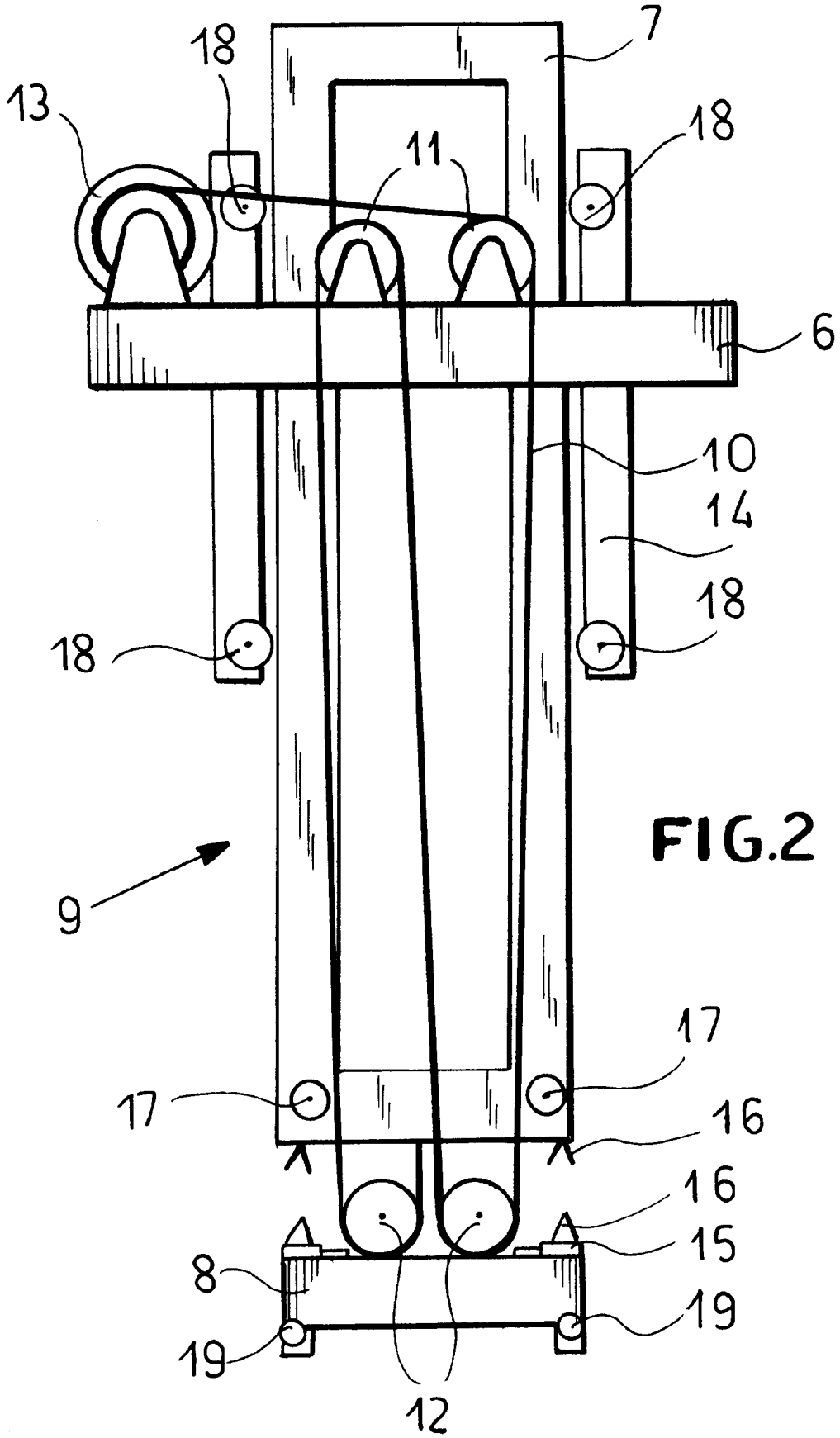
FIG. 2 is a larger-scale view of the apparatus according to the invention.

More particularly as shown in FIG. 2 a cable assembly 9 is used to displace the spreader 8 independently of the frame 7. This assembly 9 comprises one or more cables 10 passing at the support 6 over a pair of rollers 11 and at the grab 8 under two more rollers 12. One end of the cable 10 is fastened to the lower end of the frame 7 and the other is wound around a drum 13 mounted on the carriage 6 for a 3:1 mechanical advantage.

To allow the frame 7 to move vertically relative to the support 6 while inhibiting any relative horizontal movement or tipping, the support 6 is provided with vertically extending guide rails 14 having at their upper and lower ends rollers 18 on which the frame 7 rides. In addition the lower end of the support 7 carries rollers 17 that engage the cable 10 and keep it and the grab 8 suspended from it basically on center beneath the frame 7.

The upper side of the grab 8 and the lower side of the frame 7 are provided with interfitting centering formations 16, upwardly directed points on the grab 8 and downwardly directed sockets on the frame 7, that allow the grab 8 to be seated solidly against the lower end of the frame 7. Cylinders 15 are provided on the grab 8 to allow the centering pins 16 to be moved limitedly horizontally to compensate for any misalignment. The lower side of the grab 8 is provided with rollers and other formations 19 that fit with the containers being lifted in the manner well known in the art.

Figure 3:
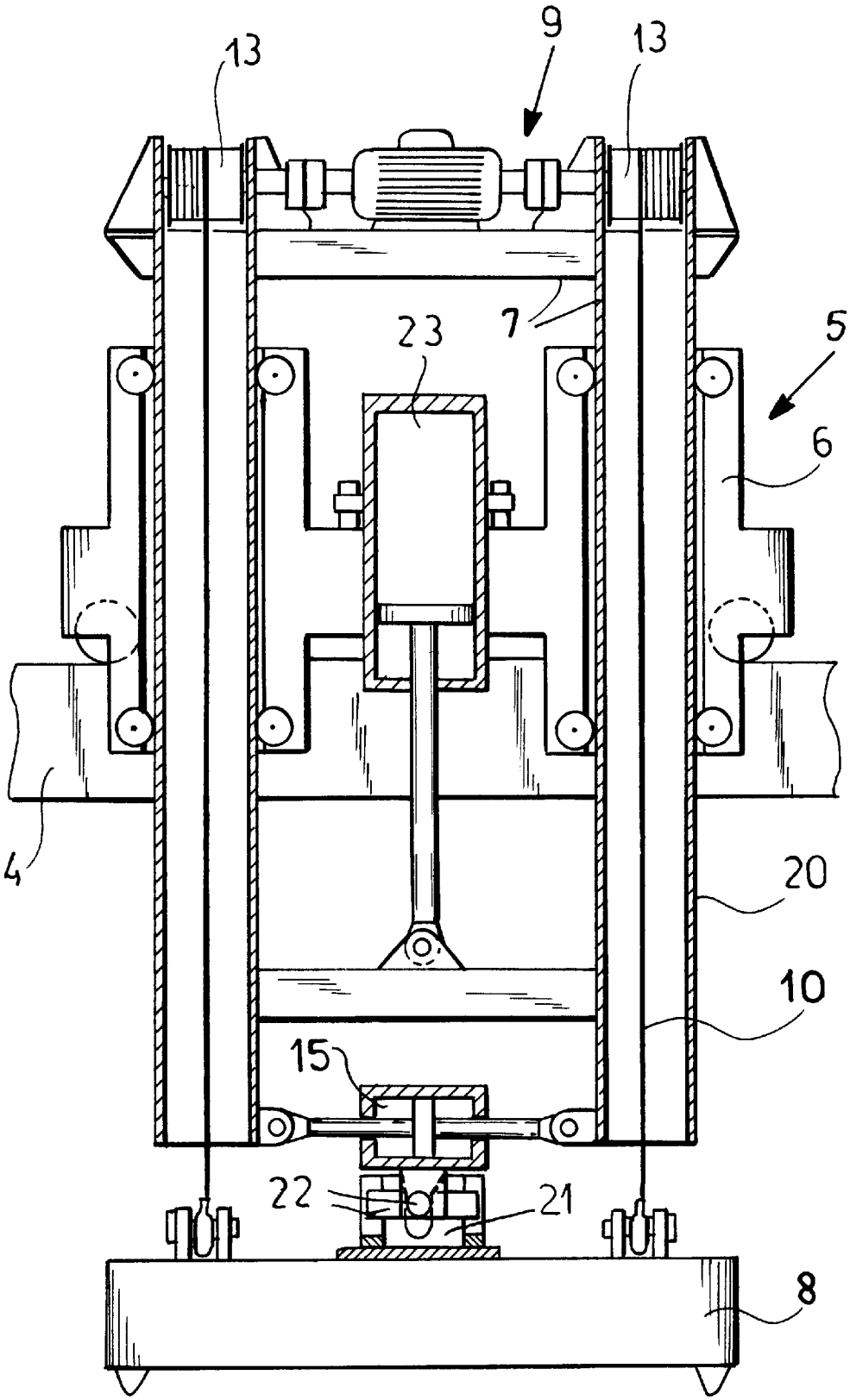
FIG. 3 is a larger-scale partly sectional view of an apparatus in accordance with the invention.

In FIG. 3 the vertically guided frame 7 has hollow columns 20 through which the cables 10 extend, and these cables have their lower ends connected directly to the grab 8. Drums 13 are here provided on the upper end of the frame 7 rather than on the support 6. In addition here a separate vertically effective double-acting cylinder 23 is provided between the support 6 and frame 7 for vertically moving it. A cross or X-bolt 22 is mounted via a double-acting cylinder 15 on the lower end of the frame 7 and fits in a cross or X-socket 21 on the grab 8 to center and stabilize the grab 8 when it is pulled up by the cables 10 against the lower end of the frame 7.

We claim:

1. An apparatus for loading into and unloading objects from a ship, the apparatus comprising:

a horizontally displaceable support;

a frame element having a lower end;

means supporting the frame element on the support only for vertical movement relative thereto;

a grab element below the frame element engageable with the objects;

a mainly vertically extending cable connected to the grab element;

means including vertically interengageable formations on the grab element and frame lower end for, when engaged together, arresting the grab element horizontally relative to the frame element;

horizontally effective actuators engaged between one of the elements and the respective formations; and means connected to the cable for reeling in and paying out the cable and thereby raising and lowering the grab element relative to the frame lower end and bringing the formations into and out of engagement with each other.

2. The loading and unloading apparatus defined in claim 1 wherein the reeling means is mounted on the support.

3. The loading and unloading apparatus defined in claim 1 wherein the reeling means is mounted on the frame element.

4. The loading and unloading apparatus defined in claim 1 wherein the cable has an outer end fixed to the grab element.

5. The loading and unloading apparatus defined in claim 1, further comprising idler rollers on the support and on the grab element over which the cable is reeved.

6. The loading and unloading apparatus defined in claim 1 wherein the cable has an outer end fixed to the frame element and the reeling means is mounted on the support.

7. The loading and unloading apparatus defined in claim 1 wherein the horizontally effective actuators are engaged between the grab element and the respective formations.

8. The loading and unloading apparatus defined in claim 1 wherein horizontally effective actuators are engaged between the frame element and the respective formations.

9. An apparatus for loading into and unloading objects from a ship, the apparatus comprising:

a horizontally displaceable support;

a frame having a lower end;

means supporting the frame on the support only for vertical movement relative thereto;

a grab below the frame engageable with the objects;

a mainly vertically extending cable connected to the grab;

means including vertically interengageable formations on the grab and frame lower end for, when engaged together, arresting the grab horizontally relative to the frame, the formations including at least one horizontally extending X-shaped bolt and at least one complementarily X-shaped socket having a horizontally extending recess complementary to the bolt; and means connected to the cable for reeling in and paying out the cable and thereby raising and lowering the grab relative to the frame lower end and bringing the formations into and out of engagement with each other.

10. The loading and unloading apparatus defined in claim 1, further comprising guides in the frame element horizontally engageable with the cable.

11. The loading and unloading apparatus defined in claim 1 wherein the grab element is provided with rollers engageable with the object.

12. The loading and unloading apparatus defined in claim 1, further comprising a vertically extensible actuator engaged between the frame element and the support.

* * * * *